US007415951B2

(12) United States Patent
Sailer et al.

(10) Patent No.: US 7,415,951 B2
(45) Date of Patent: Aug. 26, 2008

(54) VALVE TIMING MECHANISM OF AN INTERNAL COMBUSTION ENGINE

(75) Inventors: Peter Sailer, Erlangen (DE); Oliver Schnell, Veitsbronn (DE); Jochen Tovar, Erlangen (DE)

(73) Assignee: Schaeffler KG, Herzogenaurach (DE)

( * ) Notice: Subject to any disclaimer, the term of this patent is extended or adjusted under 35 U.S.C. 154(b) by 76 days.

(21) Appl. No.: 11/654,809

(22) Filed: Jan. 18, 2007

(65) Prior Publication Data

US 2007/0169736 A1 Jul. 26, 2007

(30) Foreign Application Priority Data

Jan. 21, 2006 (DE) ..... 10 2006 002 967

(51) Int. Cl.
*F01L 1/34* (2006.01)

(52) U.S. Cl. ..... 123/90.16; 123/90.44; 123/90.45; 123/90.6; 123/90.52; 74/569

(58) Field of Classification Search ..... 123/90.16, 123/90.27, 90.31, 90.44, 90.45, 90.48, 90.52, 123/90.55, 90.6; 74/567, 569
See application file for complete search history.

(56) References Cited

U.S. PATENT DOCUMENTS 7,325,523 B2 * 2/2008 Sailer et al. ..... 123/90.52

FOREIGN PATENT DOCUMENTS

DE 102 10 747 A1 10/2003

DE 10 2004 029 750 A1 1/2006

* cited by examiner

*Primary Examiner*—Ching Chang
(74) *Attorney, Agent, or Firm*—Charles A. Muserlian

(57) ABSTRACT

A valve timing mechanism of an internal combustion engine of a motor vehicle, having a camshaft having at least one cam (18), via which a switchable valve timing mechanism element (1) can be loaded with a cam stroke (s), in which locking means (12) are arranged on the valve timing mechanism element (1), which locking means (12) have a locking play (16) which is active in the direction of a valve stroke, in which the cam (18) has a base circle region (α) and a ramp region (19) with an opening ramp (γ) which adjoins the base circle region (α), and in which at least one ramp section (21) is formed on the opening ramp (γ) in order to compensate for the locking play (16). In order to provide a valve timing mechanism of an internal combustion engine, which produces sufficient idle travel of a locking play (16) of the switchable valve timing elements (1) being loaded by the cam ramps of the cams (18), and nevertheless manages with a relatively short length of the cam ramps, the cam (18) is shaped in the locking play ramp section (21) for compensating for the locking play (16) in such a way that, during a run-off movement over a cam counterelement (17) of the valve timing mechanism element (1), in the event of a rotation of the camshaft, it runs off with an increased cam velocity (v) in comparison with adjacent ramp sections (20,24), at least in one part of the locking play ramp section (21).

9 Claims, 2 Drawing Sheets

VALVE TIMING MECHANISM OF AN INTERNAL COMBUSTION ENGINE

FIELD OF THE INVENTION

The invention relates to a valve timing mechanism of an internal combustion engine, in particular of a motor vehicle, having a camshaft and having at least one cam, via which a switchable valve timing mechanism element can be loaded with a cam stroke, in which locking means are arranged on the valve timing mechanism element, which locking means have a locking play which is active in the direction of a valve stroke, in which the cam has a base circle region and a ramp region with an opening ramp which adjoins the base circle region, and in which at least one ramp section is formed on the opening ramp in order to compensate for the locking play.

BACKGROUND OF THE INVENTION

Valve timing mechanisms having switchable valve timing mechanism elements, for example switchable tappets, levers or supporting elements and correspondingly switchable cylinders, are installed in motor vehicles in order to optimize the efficiency, the fuel consumption and the exhaust gas emissions, in order, depending on the application, to switch on or switch off valves in defined operating states, to load them with different valve strokes or to actuate them with different valve control times. Switchable valve timing mechanism elements of this type are affected with a locking play of the locking means which are used, for structural reasons, in order to implement a locking action.

As is described, for example, in DE 102 10 747 A1, two pistons which lie diametrically opposite one another can be configured here as locking means. In the event of a locking action, the pistons bridge two axially movable components, which are arranged inside one another, of the valve timing mechanism element which is configured, for example, as a roller tappet. This results in an additional idle travel which acts on a valve stroke and has to be taken into consideration in the design of the cams on a camshaft, via which the gas exchange valves of the internal combustion engine are actuated.

This is expressed in the design of a ramp section within an opening ramp which adjoins a base circle region of the respective cam, which ramp section additionally has to be overcome before the actual opening process of the gas exchange valve when the cam is moved out via the valve timing mechanism element. Said ramp section therefore increases the overall length of the cam ramp. In addition to the compensation of the locking play, an increase in the locking play as a result of wear is also to be taken into consideration. In general, the mechanical rigidity of the valve timing mechanism elements is also to be considered in the compensation of the idle travel.

Furthermore, both switchable and nonswitchable valve timing mechanism elements are frequently installed in internal combustion engines, with the result that the respective ramp lengths are different. If further ramp portions are added to the ramps which are already different in any case, the cam ramps of the corresponding cams become relatively long and it becomes more difficult with an increasing length of the cam ramps to match an internal pressure of the switchable and nonswitchable cylinders via the cams.

A further ramp portion is required, in particular, in order to compensate for lowering of the frequently used hydraulic valve play compensating elements (HVA) in the internal combustion engine. HVAs serve to compensate automatically for a valve play which results from the thermal expansion and the wear of the transmission elements of the cam stroke, which emanates from the camshaft, on the gas exchange valves, in order to ensure a satisfactory operation of the internal combustion engine. The valve play compensating elements are usually configured as hydraulic tappets, having a control valve which is loaded in the closing direction via a spring and is therefore predominantly closed in the base circle region of the cam by the force of the spring. As a result, said compensating elements transmit a cam stroke directly to the gas exchange valves, as virtually rigid elements.

Valve play compensating elements are also increasingly used, in which the control valve is loaded in the opening direction. Compensating elements of this type are known as RSHVA (reverse spring hydraulic valve play compensating elements) and are described, for example, in DE 10 2004 018 386 A1, DE 10 2004 035 588 A1 and DE 10 2005 010 711 A1 which are not prior publications. In these compensating elements, the control valve is held open in the cam base circle region by the force of the spring. As a compensating element of this type can be closed by hydrodynamic and hydrostatic forces only by an oil flow which flows at the beginning of the cam elevation from a high pressure space to a low pressure space of the tappet, the compensating element initially produces an idle stroke, before the actual valve stroke begins. This idle stroke has the effect of reducing the wear on the valve timing mechanism and, in particular, has a positive effect on the idling quality (rotational speed stability during idling) of the engine. In order to compensate for the idle stroke of the RSHVAs, however, a further ramp portion is necessary, which results in a still further increased overall ramp length of the relevant cams.

As a result of the individual ramp portions, in particular in the case of a valve timing mechanism having a switchable tappet with RSHVA, a critical overall length of the cam ramp can therefore be achieved, which can result in creeping opening of the corresponding gas exchange valves or a filling loss of the corresponding cylinders. This can have an unfavorable influence on the valve overlap and therefore the valve control times. In addition, unfavorable thermal effects as a result of the creeping filling outflow are also not to be precluded. As a consequence of this, the actual advantages of switchable valve timing mechanism elements and RSHVAs, in particular with regard to the idling quality, can be reduced unfavorably, at least partially.

DE 199 02 446 A1, DE 196 30 443 A1 and DE 196 29 313 B4 are to be mentioned for a cam design having an opening ramp and a closing ramp. In said documents, the cam design is described for taking a hydraulic play compensating element into consideration. However, a person skilled in the art does not find any indications in said publications of a locking play or an additional reverse spring idle stroke being taken into consideration in the design of the opening ramp.

OBJECT OF THE INVENTION

The invention is based on the object of providing a valve timing mechanism of an internal combustion engine, which produces sufficient idle travel compensation, in particular idle travel of a locking play of the switchable valve timing mechanism elements, in the event of switchable valve timing mechanism elements being loaded by the cam ramps of the cams of a camshaft, and nevertheless manages with a relatively short length of the cam ramps.

SUMMARY OF THE INVENTION

The invention is based on the finding that the length of a ramp of a cam which acts to compensate for idle travels in the actuation of gas exchange valves can be shortened by the cam velocity, also called the ramp velocity in the following text, that is to say the temporal change in the cam stroke per camshaft angular degree, being increased in ramp sections which are suitable for this purpose by a corresponding design of the cam.

The invention therefore proceeds from a valve timing mechanism of an internal combustion engine, in particular of a motor vehicle, having a camshaft and having at least one cam, via which a switchable valve timing mechanism element can be loaded with a cam stroke, and in which locking means are arranged on the valve timing mechanism element, which locking means have a locking play which is active in the direction of a valve stroke, in which the cam has a base circle region and a ramp region with an opening ramp which adjoins the base circle region in the direction of rotation, and in which at least one ramp section is formed on the opening ramp in order to compensate for the locking play. In addition, there is provision according to the invention for the cam to be shaped in the locking play ramp section for compensating for the locking play in such a way that, during a run-off movement over a cam counterelement of the valve timing mechanism element, in the event of a rotation of the camshaft, it runs off with an increased cam velocity in comparison with adjacent ramp sections, at least in one part of the locking play ramp section.

A local velocity increase is generated in this region as a result of a suitable cam design in the region of the ramp for compensating for the locking play. To this end, there can be provision for the increased cam velocity within the locking play ramp section to have the profile of a speed harmonic. As a result, the cam stroke changes more rapidly in this region, as a result of which the locking play is more likely to be overcome. As a consequence, the locking play ramp section and therefore the overall ramp length of the cam can be shortened.

A general increase in the ramp velocity would lead to the corresponding gas exchange valves being moved into their valve seat via the running-off cam ramp at an increased velocity. This could lead to increased noise development and increased wear.

As, however, the speed harmonic is arranged in the region of the locking play according to the invention, that is to say in the region, in which the locking means or locking pistons are free and accordingly do not bear against adjacent contact faces, a higher stroke velocity is not damaging here for the interaction with other valve timing mechanism components. Therefore, the overall ramp length of the switchable valve timing mechanism components can be shortened advantageously with the utilization of this local velocity increase. This reliably prevents undesirable creeping opening of the corresponding gas exchange valves or a filling loss of the associated cylinders of the internal combustion engine, which is advantageous, in particular, for satisfactory idling quality.

Moreover, there can be provision for a local elevation to be formed on the opening ramp in the locking play ramp section. As a result, the local increase of the ramp velocity can be realized in a simple manner.

The ramp shortening according to the invention has a particularly advantageous effect in a valve timing mechanism, in which the switchable valve timing mechanism element is configured as a tappet having a hydraulic valve play compensating element in a reverse spring construction, as switchable reverse spring tappets require a comparatively long opening ramp on account of the individual compensation ramp portions, in particular in comparison with nonswitchable hydraulic tappets. Here, the locking play ramp section is formed between a ramp section for compensating for lowering of the hydraulic valve play compensating element, in particular for compensating for an idle stroke of the reverse spring hydraulic valve play compensating element, and a ramp section, in which the locking means bear against the countersurface.

In principle, however, the ramp shortening in the locking play compensation region also has a favorable effect on the valve timing mechanism control, in particular with regard to the idling behavior of the internal combustion engine, in other switchable valve timing mechanism elements with or without hydraulic play compensation or else with other play compensating elements.

As a result of the construction, a shorter cam ramp portion for compensating for the idle stroke results in switchable reverse spring compensating elements which are known per se, in comparison with nonswitchable reverse spring compensating elements. Secondly, in the switchable reverse spring compensating elements, the longer locking play ramp portion increases the overall ramp length of the cams of the switchable valve timing mechanism elements compared with the cams of the nonswitchable valve timing mechanism elements.

The result of the introduction according to the invention of the speed harmonic in the locking play ramp portion is the possibility, as can be provided, furthermore, of matching the respective overall ramp lengths of the cams, in an internal combustion engine having switchable and nonswitchable valve timing mechanism elements, at least approximately via shortening of the locking play ramp section of the corresponding cams, as a result of which particularly high idling quality can be achieved in an engine of this type.

BRIEF DESCRIPTION OF THE DRAWINGS

The invention will be explained in greater detail in the following text on the basis of some embodiments and using the accompanying drawings, in which.

DETAILED DESCRIPTION OF THE DRAWINGS

Figure 1:
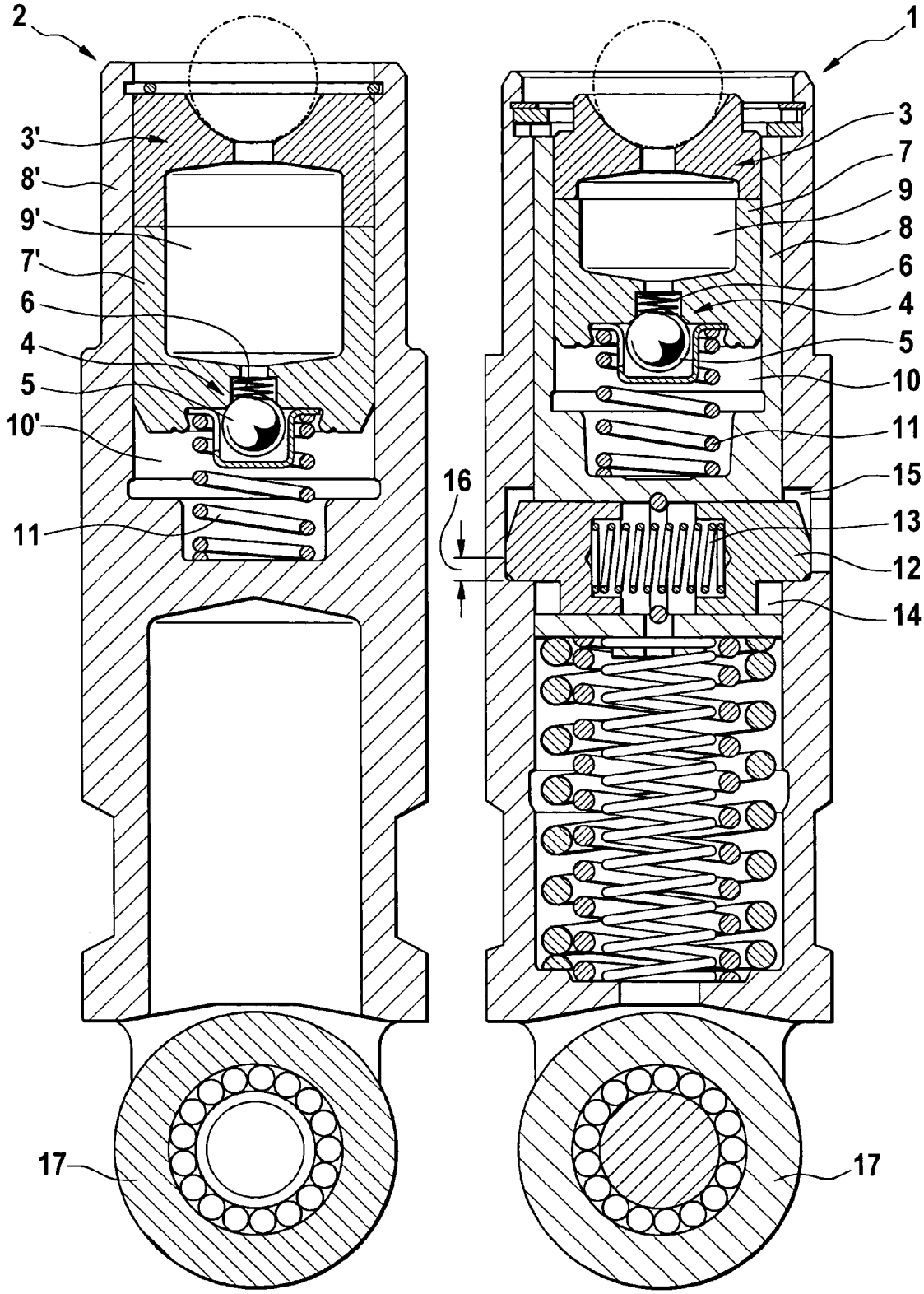
FIG. 1 shows a switchable valve timing mechanism element which is configured as a roller tappet and a nonswitchable valve timing mechanism element which is configured as a roller tappet, in each case having a reverse spring hydraulic valve play compensating element, in a longitudinal section.

Accordingly, FIG. 1 shows a switchable valve timing mechanism element 1 and a nonswitchable valve timing mechanism element 2 of a valve timing mechanism of an internal combustion engine in a motor vehicle, which are configured as roller tappets with a reverse spring hydraulic valve play compensating element (RSHVA) 3 and 3', respectively. The construction and the method of operation of an RSHVA of this type are known per se. A central component here is a control valve 4 having a control valve ball 5 and a control valve spring (reverse spring) 6.

The control valve 4 is arranged on a piston 7 or 7' which is guided movably in a cylindrical housing 8 or 8'. A low pressure space 9, 9' within the piston 7, 7' is separated by the control valve 4 from a high pressure space 10, 10' below the piston 7, 7'. The housing 8, 8' and the piston 7, 7' are supported elastically with respect to one another via a piston spring 11.

In order to actuate a gas exchange valve (not shown) which is assigned to the valve timing mechanism element or tappet 1, 2, the control valve 4 has to first of all be closed via a loading of the control valve ball 5 counter to the control valve spring 6 by the control oil which flows from the high pressure space 10, 10' to the low pressure space 9, 9', before a cam stroke "s" acts on the gas exchange valve. Here, the piston 7, 7' and the housing 8, 8' first of all perform a compression movement which has the effect of an idle stroke of the play compensating element 3, 3'.

In order optionally to activate or to deactivate the switchable tappet 1 and therefore the corresponding valve or the cylinder, locking means 12 are provided. The locking means 12 are advantageously configured in a known manner as pistons which lie diametrically opposite one another and are arranged in receptacles 14 of an inner housing component of the tappet 1. For locking, the pistons 12 are pressed via a compression spring 13 into outer receptacles 15 of an outer component, as a result of which a relative movement of the inner housing component of the tappet 1 with respect to the outer component is blocked. For unlocking, the pistons 12 are pressed out of their outer receptacles 15 hydraulically (in a manner which is not shown in greater detail). In the direction of a longitudinal axis of the tappet 1, the locking means 12 are affected by a locking play 16 which has the effect of a locking play idle travel which has to be overcome in addition to the idle stroke of the RSHVA 3. The roller tappets 1, 2 can be loaded via rollers which are configured as cam counterelements 17.

Figure 2:
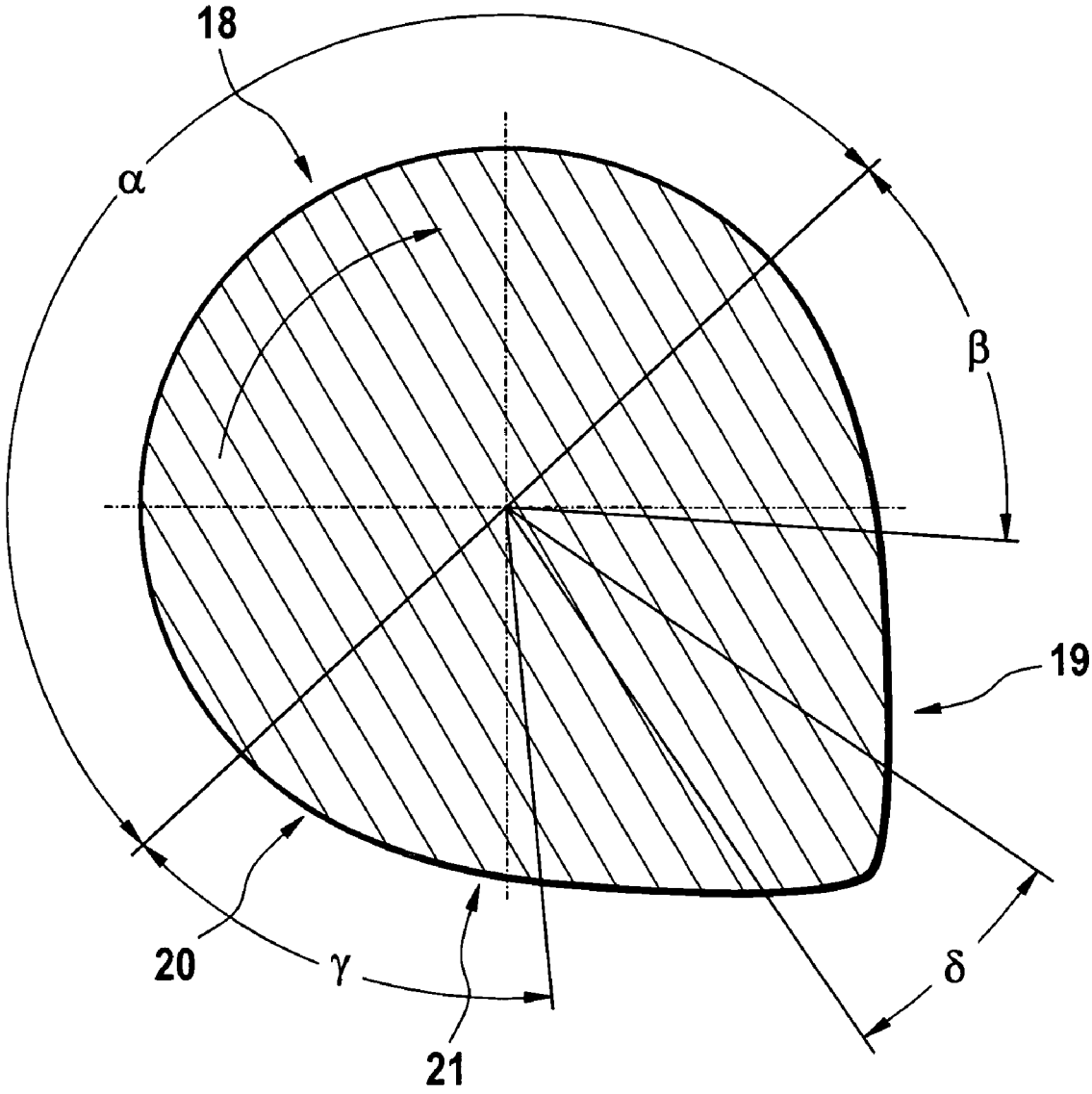
FIG. 2 shows a cam of a camshaft having a ramp region, in a side view in section.

FIG. 2 shows a cam 18 of a camshaft (not shown) for the switchable tappet 1 having a base circle region α and a ramp region 19. During run-off of the cam 18 over the roller 17, the base circle region α is adjoined by an opening ramp γ. A ramp section 20 for compensating for the idle stroke and a ramp section 21 for compensating for the locking play 16 of the tappet 1 lie within the opening ramp γ. During the further run-off movement, the valve is opened via a cam peak in the region δ and is closed again in the further profile in a closing region β, which is not to be considered further here.

In an internal combustion engine having nonswitchable tappets 2 (RSTH for short) and switchable tappets 1 (RSSH for short), different diameters of the hydraulic play compensating elements 3 and 3' and correspondingly different permissible velocities, in order to close the control valve ball 5, result on account of the usual constructions of these components, as can be seen in FIG. 1.

This is clarified in the following exemplary calculation:

A critical closing velocity of 14 mm/s for the RSTH and of 19.5 mm/s for the RSSH is to be assumed at an oil temperature of 90° C. If the aim is now that the compensating element generates a large idle stroke at an idling rotational speed and as small an idle stroke as possible above 1000 RPM, as is desired for achieving a high idling rotational speed, the following values result for the cam or ramp velocities v:

$$RSTH(14\ \text{mm/s})/\pi/(1000\ \text{rad/min})*(60\ \text{s/min})=0.27\ \text{mm/rad},$$

$$RSSH(19.5\ \text{mm/s})/\pi/(1000\ \text{rad/min})*(60\ \text{s/min})=0.37\ \text{mm/rad}.$$

The result of this for the nonswitchable RSTH is a ramp portion having a constant velocity between 7° cam(shaft) angle, CA for short (above 1000 RPM; small idle stroke) and 15° CA (idling; large idle stroke). In contrast, the result for the switchable RSSH is a shorter constant velocity ramp between 6° CA (above 1000 RPM; small idle stroke) and 10° CA (idling; large idle stroke).

Secondly, a longer ramp portion for compensating for the locking play 16 is added in the case of the RSSH, which longer ramp portion reaches approximately from 12° CA to 27° CA in this exemplary calculation. This is then adjoined by a ramp section having a ramp velocity of, for example, 0.8 mm/rad, at the beginning of which the locking pistons make contact with their bearing faces. The overall result for the RSSH is thus a considerably greater overall ramp length than for the RSTH (corresponding to 27° CA compared with 15° CA).

According to the invention, these undesirably different ramp lengths are converged by a shortening of the locking play ramp section 21 of the switchable tappet 1. The cam velocity v is plotted on the ordinate axis over the cam angle CA on the abscissa for the switchable tappet 1.

At rotational speeds above 1000 RPM, the reverse spring tappet 1 generates only a small idle stroke. Accordingly, only a small ramp length or camshaft angle CA is required for compensation. The control valve ball 5 already closes in a region 22 (FIG. 3). During idling, in contrast, the RSHVA 3 generates a large idle stroke, with the result that the constant velocity ramp 20 is required for compensation, until the control valve ball 5 closes in the region 23. After the RSHVA 3 is closed and before the locking pistons 12 make contact and the actual valve actuation begins in a region 24, the locking play 16 is to be compensated for in the region 21. This ramp section 21 is shortened by a corresponding cam design to a suitable length (corresponding to approximately 17° CA in the above example) by a speed harmonic 25 being generated, with the result that the overall ramp lengths for the nonswitchable tappet 2 and the switchable tappet 1 are approximately identical.

LIST OF DESIGNATIONS

1 Switchable valve timing mechanism element, tappet
2 Nonswitchable valve timing mechanism element, tappet
3, 3' Reverse spring hydraulic valve play compensating element (RSHVA)
4 Control valve
5 Control valve ball
6 Control valve spring
7, 7' Piston
8, 8' Housing
9, 9' Low pressure space
10, 10' High pressure space
11 Piston spring
12 Locking means
13 Compression spring
14 Inner receptacle
15 Outer receptacle
16 Locking play
17 Cam counterelement
18 Cam
19 Ramp region
20 Idle stroke ramp section
21 Locking play ramp section
22 Closing region, control valve ball, above idling region
23 Closing region, control valve ball, in idling region
24 Locking means contact region
25 Speed harmonic
NW Cam angle
s Cam stroke
v Cam velocity
a Cam acceleration
α Base circle region
β Closing ramp γ Opening ramp δ Cam peak

The invention claimed is:

1. A valve timing mechanism of an internal combustion engine of a motor vehicle, having a camshaft having at least one cam, via which a switchable valve timing mechanism element can be loaded with a cam stroke (s), in which locking means are arranged on the valve timing mechanism element, which locking means have a locking play which is active in the direction of a valve stroke, in which the cam has a base circle region (α) and a ramp region with an opening ramp (γ) which adjoins the base circle region (α), and in which at least one locking play ramp section is formed on the opening ramp (γ) to compensate for the locking play, wherein the cam is shaped in the locking play ramp section in such a way that, during a run-off movement over a cam counterelement of the valve timing mechanism element, in the event of a rotation of the camshaft, it runs off with an increased cam velocity (v) in comparison with adjacent ramp sections, at least in one part of the locking play ramp section.

2. The valve timing mechanism of claim 1, wherein a local elevation is formed on the opening ramp (γ) of the cam in the locking play ramp section.

3. The valve timing mechanism of claim 1, wherein the increased cam velocity (v) within the locking play ramp section has the profile of a speed harmonic.

4. The valve timing mechanism of claim 1, wherein the switchable valve timing mechanism element is configured as a tappet.

5. The valve timing mechanism of claim 1, wherein the switchable valve timing mechanism element has a hydraulic valve play compensating element.

6. The valve timing mechanism of claim 5, wherein the hydraulic valve play compensating element is configured as a reverse spring compensating element.

7. The valve timing mechanism of claim 5, wherein the locking play ramp section is formed between a ramp section for compensating for lowering of the hydraulic valve play compensating element and a ramp section, in which the locking means bear against a countersurface.

8. The valve timing mechanism of claim 5, wherein the locking play ramp section is formed between a ramp section for compensating for an idle stroke of the reverse spring hydraulic valve play compensating element and the ramp section, in which the locking means bear against a countersurface.

9. The valve timing mechanism of claim 1, wherein the respective overall ramp lengths of the cams, in an internal combustion engine having switchable and nonswitchable valve timing mechanism elements, are matched at least approximately via shortening of the locking play ramp section of the corresponding cams with the aid of the speed harmonic.

* * * * *